US006634924B1

(12) United States Patent
Ono et al.

(10) Patent No.: US 6,634,924 B1
(45) Date of Patent: Oct. 21, 2003

(54) POLISHING APPARATUS

(75) Inventors: Koji Ono, Kanagawa-ken (JP); Shozo Oguri, Kanagawa-ken (JP); Kenichi Sasabe, Tokyo (JP); Masato Kurita, Kanagawa-ken (JP); Yasuhisa Kojima, Kanagawa-ken (JP); Tadanori Egawa, Kanagawa-ken (JP); Kenichi Shigeta, Kanagawa-ken (JP)

(73) Assignees: Ebara Corporation, Tokyo (JP); Kabushiki Kaisha Toshiba, Kanagawa-ken (JP)

( * ) Notice: Subject to any disclaimer, the term of this patent is extended or adjusted under 35 U.S.C. 154(b) by 14 days.

(21) Appl. No.: 09/669,883

(22) Filed: Sep. 27, 2000

(30) Foreign Application Priority Data

Sep. 28, 1999 (JP) ..... 11-274259

(51) Int. Cl.[7] ..... B24B 49/00

(52) U.S. Cl. ..... 451/5; 451/8; 451/41; 451/287

(58) Field of Search ..... 451/5, 8, 9, 10, 451/41, 285–290

(56) References Cited

U.S. PATENT DOCUMENTS 3,137,587 A * 6/1964 Wieder et al.
5,447,890 A * 9/1995 Kato et al. ..... 437/249
5,733,171 A * 3/1998 Allen et al. ..... 451/5
5,823,853 A 10/1998 Bartels et al.
5,838,447 A 11/1998 Hiyama et al.
5,872,633 A 2/1999 Holzapfel et al.
5,897,424 A * 4/1999 Evans et al. ..... 451/41
5,948,205 A * 9/1999 Kodera et al. ..... 451/287
6,076,256 A * 6/2000 Drake et al. ..... 29/825
6,241,578 B1 * 6/2001 Togawa et al. ..... 451/5

* cited by examiner

*Primary Examiner*—M. Rachuba
(74) *Attorney, Agent, or Firm*—Wenderoth, Lind & Ponack L.L.P.

(57) ABSTRACT

Disclosed is a polishing apparatus that comprises a polishing tool, a substrate holding member, a measuring device to measure a drive current of a drive unit while the drive unit drives at least one of the polishing tool and the substrate holding member, and a failure detection unit to detect either jumping of the substrate from the substrate member or breakage of the substrate. While a substrate is held by a substrate holding member and pressed against the polishing tool during a polishing operation, the failure detection unit will detect jumping of the substrate from the substrate holding member or breakage of the substrate based on a comparison of the value of the drive current with a threshold value, or a comparison of a waveform pattern of the drive current with a predetermined waveform pattern.

12 Claims, 12 Drawing Sheets

POLISHING APPARATUS

BACKGROUND OF THE INVENTION

The present invention relates to a polishing apparatus, and more particularly, to a polishing apparatus adapted so as to detect a failure during polishing a substrate such as a semiconductor wafer or the like. The failure can include a breakage of the wafer or an event of the wafer jumping from a predetermined position, which may occur during polishing the substrate.

In recent years semiconductor devices have become so highly integrated that circuit interconnections have become thinner and that distances between these interconnections have also become smaller. Particularly, for an optical lithography of 0.5 $\mu$m or less, the depth of focus has become so short that a high degree of flatness on an imaging surface of an exposure apparatus is required. Hitherto, a self-flattening CVD apparatus or an etching apparatus has been used as a flattening apparatus for flattening a semiconductor wafer. These apparatuses, however, do not accomplish a sufficient degree of flatness. Therefore, a polishing apparatus has recently been extensively adopted to flatten a semiconductor wafer because a higher degree of flatness can be expected to be accomplished more readily than the flattening apparatuses described immediately above.

The polishing apparatus of this type is composed of a turntable and a top ring member, each rotating at a number of rotations discretely and independently from each other, and an abrasive cloth is attached on top of the turntable. Between the turntable and the top ring member is interposed a substrate (e.g., a semiconductor wafer), and the substrate is pressed against a top surface of the abrasive cloth at a predetermined pressure. The surface of the substrate is then polished to a predetermined level of flatness and to a mirror surface while a polishing fluid is being fed thereto. After the completion of the polishing process, the substrate is detached from the top ring member and subjected to post-processing processes, including a cleaning process.

It is to be noted herein; however, that the substrate may break and broken pieces may scatter on the abrasive cloth during the polishing process. Damage to the surface of a new substrate results if the abrasive cloth is used again. Therefore, a new abrasive cloth has to be used whenever a substrate breaks. On the other hand, even if a substrate is not broken into pieces, a failure of the substrate may result, for instance, when the substrate jumps from the top ring member during the polishing process. If the substrate is a semiconductor silicone wafer or the like made of a brittle material and the substrate jumps from the top ring member, the substrate may be damaged or chipped at its outer peripheral portion due to impact with a wall surface or the like of the turntable. The damaged substrate is very likely to be broken by application of a slight force onto the damaged portion or at a position close to the damaged portion, when the damaged substrate is polished again.

In order to solve the problems as described above, proposals to prevent a failure while polishing, including a breakage or jump of a substrate from the top ring member, have been devised. For instance, there has been proposed a process for reducing an occurrence of breaking or chipping of a substrate upon polishing the substrate by using a polishing apparatus with a buffer member such as an elastic mat interposed between a bottom surface of the top ring member and the substrate. Alternatively, there has been proposed a process whereby a jump of a substrate is prevented by fixing the substrate within the top ring member while guiding an outer periphery of the substrate.

These proposals, however, are concerned with precautionary measures to prevent a breakage of jump of the substrate, and are useless to deal with an event once the substrate is broken or has jumped outside the top ring member. To deal with an event of a substrate jumping from the top ring member, there has hitherto been adopted a process for immediately suspending a polishing operation of a polishing apparatus as a detection system detects a jump of the substrate outside the top ring member. The detection system is devised to detect the jumping of the substrate from the top ring member and is disposed outside the top ring member.

This process, however, suffers from a problem in that the polishing operation cannot be suspended rapidly because the jumping of the substrate can only be detected after the substrate has already jumped, with the result that the timing of detection is delayed.

Moreover, this process has another problem in that a failure upon polishing caused by a breakage of the substrate cannot be detected. As a result, there is a risk that the polishing of the substrate is continued unless the broken substrate jumps from the top ring member.

SUMMARY OF THE INVENTION

Therefore, the present invention has been completed under circumstances as described above and has as an object to provide a polishing apparatus that can prevent an occurrence of damages due to a failure while polishing a substrate, including a breakage or a jump of the substrate, by continually managing polishing operations of the substrate during the polishing process.

In order to achieve the object, one aspect of the present invention provides a polishing apparatus comprising a polishing tool and a substrate holding member to hold a substrate and press a surface of the substrate against the polishing tool. The polishing tool and the substrate holding member are arranged so as to more relatively to each other to polish the substrate. A sensor is disposed outside the substrate holding member for sensing a distance between the sensor and a surface of the polishing tool. And, a control unit is disposed to determine an occurrence of a failure while polishing the substrate, including a breakage or jump thereof from the substrate holding member, on the basis of a variation in the distance measured by the sensor caused by an intervention of the substrate above the surface of the polishing tool.

In another aspect, the polishing apparatus according to the present invention comprises a polishing tool and a substrate holding member to hold a substrate and press a surface of the substrate against the polishing tool. The polishing tool and the substrate holding member are arranged so as to move relatively to each other to polish the substrate. A failure detection sensor to detect a polishing failure while polishing the substrate, including a breakage or jump of the substrate, is disposed within or above the substrate holding members so as to detect such a polishing failure prior to a jump of the substrate from the substrate holding member.

In preferred embodiments of this aspect of the present invention, the failure detection sensor may include a supersonic sensor, a displacement sensor, a piezoelectric element, a distortion sensor or a vibration sensor.

In a further aspect of the present invention, the polishing apparatus comprises a polishing tool and a substrate holding member to hold a substrate and press a surface of the substrate against the polishing tool. The polishing tool and the substrate holding member are arranged so as to move relatively to each other to polish the substrate. A condenser is composed of electrode plates disposed so as to hold therebetween both faces of the substrate held by the substrate holding member, or electrode plates disposed so as to sandwich the substrate which has jumped outside the substrate holding member. A electric power source is disposed to apply a predetermined constant voltage to the condenser, and an ammeter is disposed to measure a current passing through the condenser, whereby a polishing failure during polishing, including breakage or a jump of the substrate, is detected.

In a still further aspect of the present invention, the polishing apparatus comprises a polishing tool and a substrate holding member to hold a substrate and press a surface of the substrate against the polishing tool. The polishing tool and the substrate holding member are arranged so that they move relatively to each other to polish the substrate. A contact member is disposed in contact with a bottom face of the substrate holding member or with the polishing tool at its periphery. And, a measuring system is disposed to allow a current to flow between the contact member and a surface of the polishing tool and to measure a current value therebetween, whereby a failure during polishing, including breakage or a jump of the substrate from the substrate holding member, is detected on the basis of a variation in the current value caused by the substrate passing between the contact member and the surface of the polishing tool.

In a still further aspect of the present invention, the polishing apparatus comprises a polishing table and a substrate holding member to hold a substrate and press a surface of the substrate against the polishing tool. The polishing tool and the substrate holding member are arranged so that they more relatively to each other to polish the substrate. A measuring device is disposed to measure a drive current of a drive unit for driving at least one of the polishing tool and the substrate holding member. And, a failure detection unit is disposed to detect a polishing failure while polishing the substrate, including breakage or a jump of the substrate from the substrate holding member, on the basis of a comparison of the drive current during polishing with a threshold value, or a comparison of a waveform pattern of the drive current at the time of causing the polishing failure.

Other objects, features and advantages of the present invention will become apparent in the course of the following description with reference to the accompanying drawings.

DESCRIPTION OF REFERENCE NUMERALS AND SYMBOLS

110, 110*a*, 110*b*: polishing machine, 1: polishing tool, 2: polishing table (turntable), 3: rotary table shaft, 4: top ring, 5: rotary top-ring shaft, 6: turn arm of top ring, 7: rotary turn-arm shaft, S: polishing fluid (slurry, 50: polishing fluid supply tube, 51: arm, 10: supersonic sensor (failure detection sensor), 10*a*: supersonic wave transmit section, 10*b*: supersonic wave receive section, 43: control unit, 45: first motor control section for controlling a motor driving turntable, 46: second motor control section for controlling a motor driving top ring, W: semiconductor wafer (substrate), 10-1, 10-2: supersonic sensors (failure detections sensors), 4-1: guide ring, 4-4, 4-5: passages, 11-1, 12-1: circular negative electrode plates, 11-2, 12-2: Ring-shaped positive electrode plates, 4–6: backing member, 17: support bar, V1, V2, V3: voltage sources, 16-1, 16-2: slip rings, 20: ring-shaped conductive member, 21: ring-shaped contact member, 22-1: conductive contact member, 22-2: conductive contact member, 23-1: conductive member, 23-2: conductive member, A1, A2, A3: ammeters, 24, 25, 26-1, 26-2: piezoelectric elements, 27-1, 27-2: supports, 28: spacer, 30: rotation drive motor, 32-1: motor driver for rotating top ring, 32-2: measuring device for measuring number of rotations of top ring, 32-3: measuring device for measuring a current for rotating top ring, 32-4: wafer spring out and disorder detection section, 33: vibration sensor, 34-1: amplifier, 34-2: band path filter, 34-3: vibration analyzer, 34-4: wafer spring out and disorder detection section, 34-5: drive control unit for controlling drive of the polishing apparatus, 35: displacement sensor of a non-contact type, 35-1: displacement measuring section, 35-2: failure detection section, 35-3: drive control unit for controlling drive of the polishing apparatus.

DESCRIPTION OF THE PREFERRED EMBODIMENTS

The present invention will be described in more detail by taking as an example a chemical-mechanical polishing apparatus (a CMP apparatus) with a cleaning device for use in the present invention.

Figure 13:
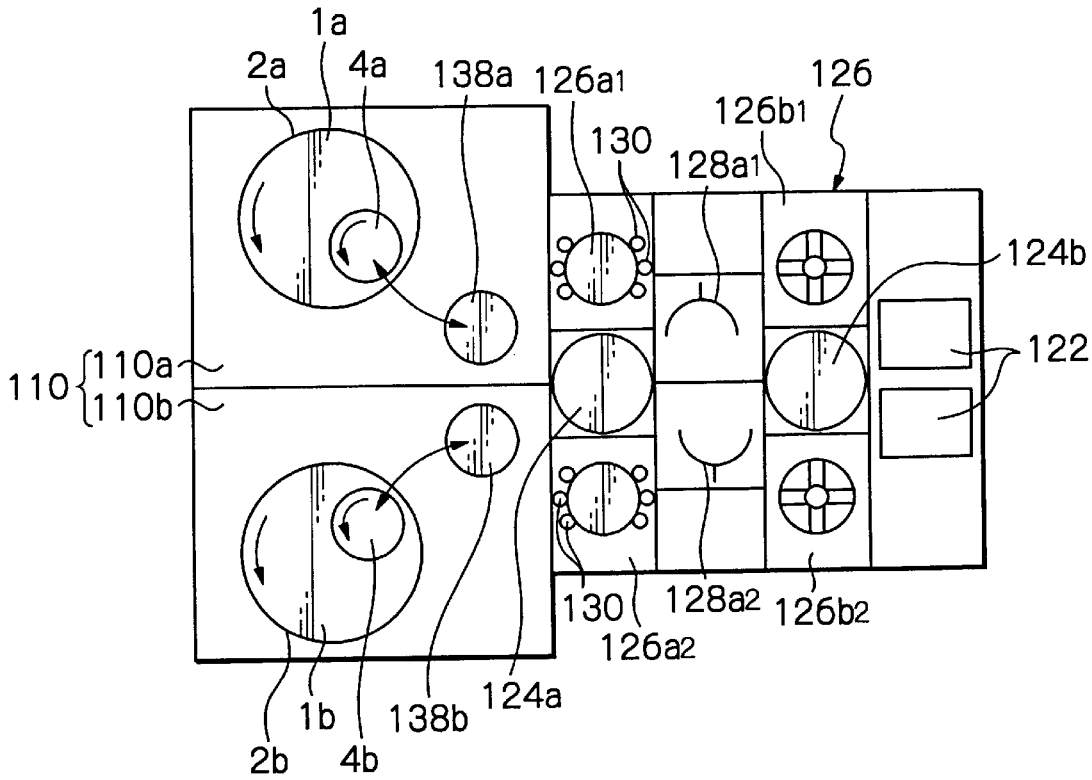
FIG. 13 is a schematic view showing an entire outline of an example of the polishing apparatus with a cleaning device.

FIG. 13 is a schematic view showing an entire outline of an example of the polishing apparatus of this type. As shown in FIG. 13, the polishing apparatus includes a polishing machine 110 and a cleaning device 126. The polishing machine 110 may comprise two polishing machines 110*a* and 110*b* disposed symmetrically on the left-hand and right-hand sides along a direction of passage of a substrate. The cleaning device 126 is composed of two primary cleaning devices 126*a*1 and 126*a*2 as well as two secondary cleaning devices 126*b*1 and 126*b*2. The cleaning devices 126*a*1 and 126*b*1 are disposed on the side of the polishing machine 110*a* and the cleaning devices 126*a*2 and 126*b*2 are disposed on the side of the polishing machine 110*b*. A group of the cleaning devices 126*a*1 and 126*b*1 is located symmetrically with respect to another group of the cleaning devices 126*a*2 and 126*b*2. Further, two reversing devices 128*a*1 and 128*a*2 are likewise disposed symmetrically with respect to each other so as to correspond with the polishing machines 110*a* and 110*b*, respectively. Likewise, two transport machines 124*a* and 124*b* and two load-unload portions 122 are disposed symmetrically with respect to each other.

The polishing machine 110*a* is composed of a polishing table 2*a* and a top ring 4*a* for polishing a semiconductor wafer held on its bottom surface by pressing it against the polishing table 2*a*. Likewise, the polishing machine 110*b* is composed of a polishing table 2*b* and a top ring 4*b* for polishing a semiconductor wafer held on its bottom surface by pressing it against the polishing table 2*b*.

For the polishing apparatus having the configuration as described above, a semiconductor wafer is transferred from the load-unload portion 122 through the transport machines 124*a* and 124*b* to a delivery device 138*a*. The semiconductor wafer is then attached to the bottom surface of the top ring 4*a* by means of the delivery device 138*a* and then transferred onto the polishing table 2*a*. Likewise, another semiconductor wafer transferred from the load-unload portion 122 onto a delivery device 138*b* is attached to the bottom surface of the top ring 4*b* and then transferred onto the polishing table 2*b*. On the top surface of the polishing tables 2*a* and 2*b* are mounted polishing tools 1*a* and 1*b*, respectively. Each polishing tool has a polishing face on its top surface and includes a polishing pad, rubstone or any other appropriate means. The semiconductor wafer is polished or ground by pressing it against the polishing face of the polishing tool while feeding a polishing fluid (e.g., a polishing material having a predetermined particle size suspended in all alkali aqueous solution in the event where an insulating membrane (an oxide membrane) coated on a Si wafer is to be polished), and rotating the polishing table 2*a* or 2*b* and the top ring 4*a* or 4*b*. After the polishing has finished, the polished semiconductor wafer is returned to the load-unload portion 122 after performing a cleaning-drying process.

Each of the primary cleaning devices 126*a*1 and 126*a*2 is a cleaning machine of a low-speed rotary type that can rotate a wafer at a low speed by rotation of a plurality of upright rollers 130 disposed so as to enclose the wafer. The wafer is held at its outer peripheral edge portion through grooves formed at upper outer peripheries of the rollers 130. Further, a cleaning member composed of a sponge of a roller type or of a pencil type, or any other appropriate member, is disposed so as to come into contact with the wafer from both its top and bottom and then be removed therefrom. Each of the secondary cleaning devices 126*b*1 and 126*b*2 is a cleaning machine of a high-speed rotary type that can rotate the wafer at a high speed. Each of the secondary cleaning devices has four arms extending in a radial direction, which arms clamp the wafer at a top end of a rotary shaft.

After the polishing process is completed, the cleaning process is carried out in a manner as will be described hereinafter. The cleaning process involves, first, cleaning by scrubbing a wafer with a cleaning member while feeding a cleaning fluid to the top and bottom surfaces of the wafer and rotating the wafer by the primary cleaning device 126*a*1 or 126*a*2.

Then, the wafer is cleansed by the secondary cleaning device 126*b*1 or 126*b*2 and dried while rotating it at a high speed. After the cleaning process and the drying process are completed, the wafer is returned to the load-unload portion 122 by means of a clean hand of the transport machine 126*b*.

The polishing apparatus according to the present invention can adopt a parallel operation method and a straight operation method. In the present invention, the parallel operation method is arranged so as to comprise polishing two sheets of wafers separately by the polishing machines 110*a* and 110*b*, respectively. The straight operation method is arranged so as to comprise transferring one sheet of wafers to the polishing machine 110*a* and then to the polishing machine 110*b*, and polishing the sheet separately by each of the polishing machines 110*a* and 110*b*.

The parallel operation method uses each of the polishing machines 110*a* and 110*b* for subjecting a substrate to normal polishing, using a polishing material, and to finish polishing. This method allows a water-polishing step to be carried out without using any polishing material at different times, thereby enabling effective transferal of the semiconductor wafers by the transport machines 124*a* and 124*b*. The polishing apparatus for use in this invention includes the polishing machines 110*a* and 110*b*, the primary cleaning devices 126*a*1 or 126*a*2, as well as the secondary cleaning device 126*b*1 or 126*b*2 in the manner as described above. Therefore, two wafer-processing lines can be provided: i.e. a first wafer-processing line comprising a polishing step performed by the polishing machine 110*a*, a primary cleaning step performed by the primary cleaning device 126*a*1, and a secondary cleaning step performed by the secondary cleaning device 126*b*1; and a second wafer-processing line comprising a polishing step performed by the polishing machine 110*b*, a primary cleaning step performed by the primary cleaning device 126*a*2, and a secondary cleaning step performed by the secondary cleaning device 126*b*2. This system allows two transport lines, for transferring semiconductor wafers, to be operated on separately from each other and in a parallel fashion without causing one transport machine to interfere with the operation of the other transport machine. Therefore, this system remarkably improves efficiency of the polishing operation of the polishing apparatus.

On the other hand, the straight operation method involves conducting the normal polishing step for polishing a semiconductor wafer with the polishing machine 110*a*, and conducting the water-polishing step for polishing the semiconductor wafer transferred to the other polishing machine 110*b* from the polishing machine 110*a*. If contamination from the polishing machines does not cause any problem, the semiconductor wafer may be transferred from the one polishing machine 110*a* to the other polishing machine 110*b* by the transport machine 124*a*. On the other hand, if the problem with contamination has to be taken into account, the semiconductor wafer is first subjected to the normal polishing step with the polishing machine 110*a*, and is then subjected to the water polishing step with the polishing machine 110*b* after the semiconductor wafer is transferred through the transport machine 124*a* to the primary cleaning device 126*a*1 and subjected to the primary cleaning process. The cleaning process with the primary cleaning device 126*a*1 may be carried out by using an appropriate cleaning agent in accordance with the kind of slurry used for the polishing machine 110*a*. For the straight operation method for use in this invention, the normal polishing step and the water polishing step are carried out separately by the polishing tables 2*a* and 2*b*, respectively, so that a polishing fluid and purified water on the polishing tables are not required to be exchanged whenever the polishing steps are conducted. This system can shorten the time required for the polishing process and save amounts of the polishing fluid and purified water. This may eventually lead to a reduction in costs of manufacturing semiconductor wafers.

For the polishing apparatus according to the present invention, each of the polishing machines 110 (110*a* and 110*b*) is provided with a failure detection system that can detect an occurrence of a polishing failure upon polishing a semiconductor wafer (a polishing substrate).

FIRST EMBODIMENT

Detection of a failure by a supersonic sensor

Figure 1:
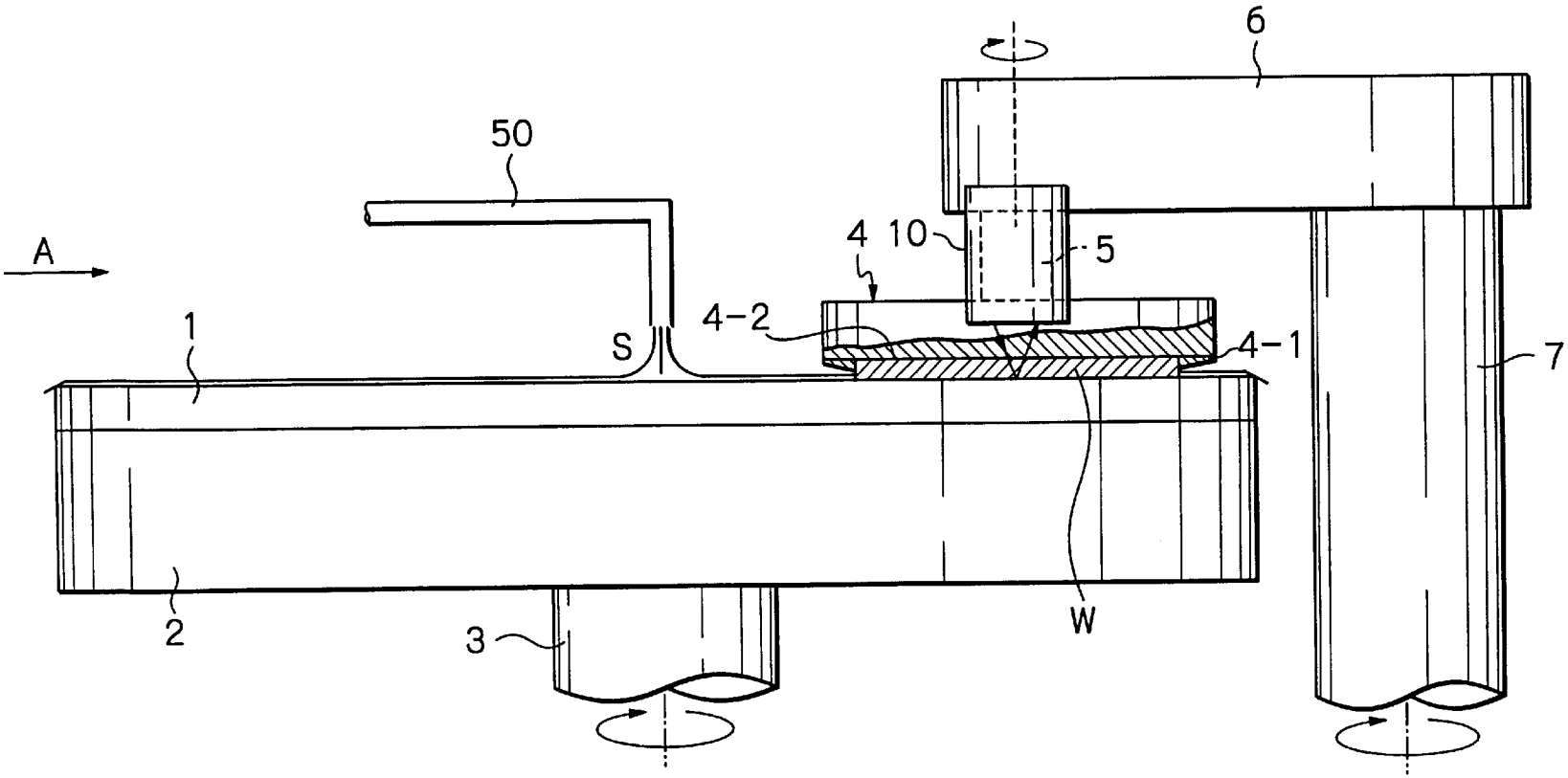
FIG. 1 is a schematic front view showing an essential portion of a polishing table and a top ring disposed in a polishing apparatus of a first embodiment of the present invention.

An example of detecting a polishing failure by a supersonic sensor will be described with reference to FIGS. 1 and 2. FIG. 1 shows an essential portion of the polishing table (turntable) 2 and the top ring 4 disposed in the polishing machine 110, and FIG. 2 shows the essential portion thereof when viewed from the arrow A in FIG. 1.

Figure 2:
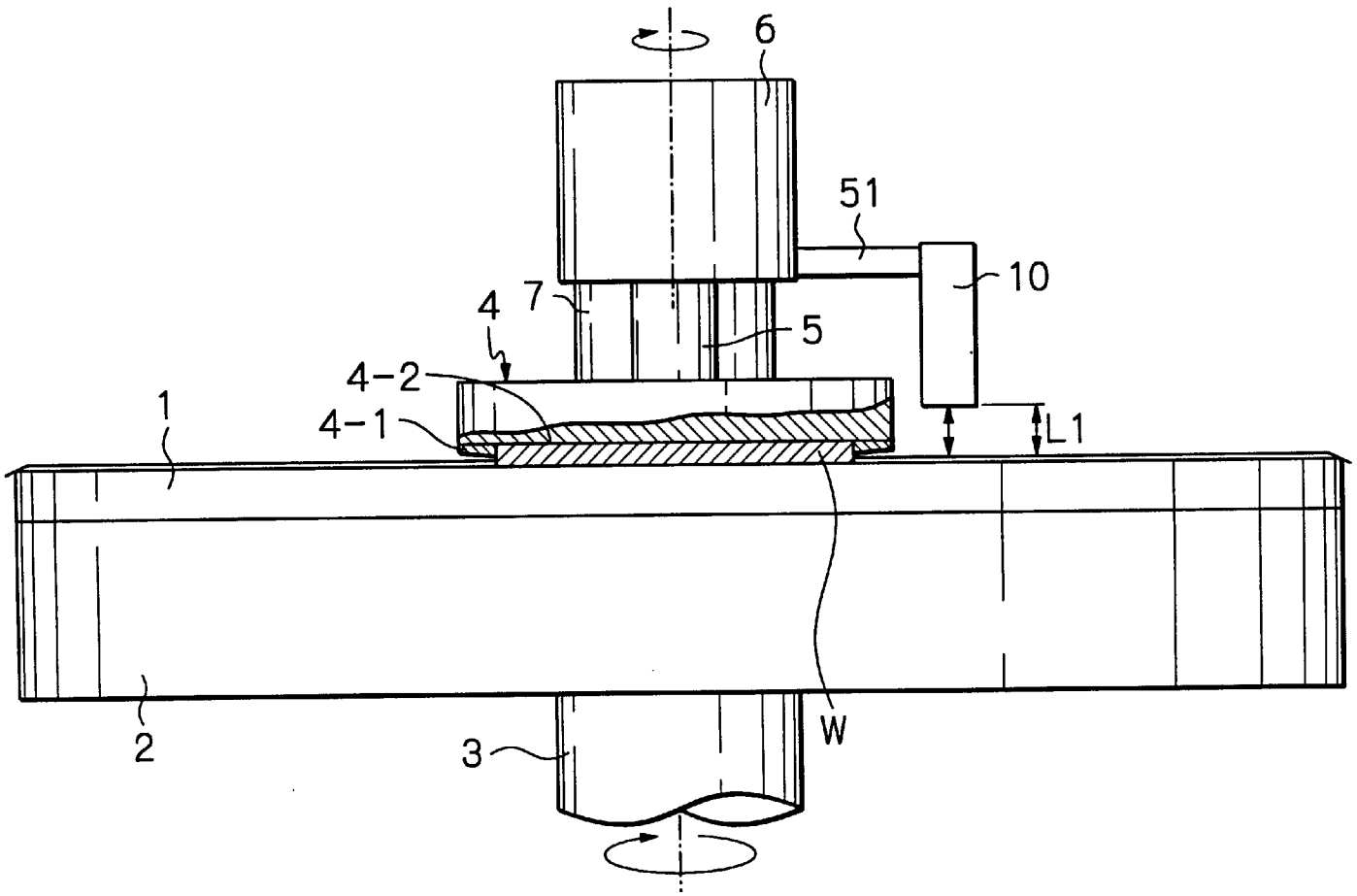
FIG. 2 is a schematic side view showing the essential portion of the polishing table and the top ring, when viewed from arrow A indicated in FIG. 1.

As shown in FIGS. 1 and 2, the polishing table 2 is of a disk shape having a rotary table shaft 3 for rotating the polishing table 2 disposed at its center under a bottom surface thereof. On a top surface of the polishing table 2 is mounted the polishing tool 1 composed of a polishing pad, rubstone or the like.

The top ring 4 has a rotary top-ring shaft 5 for rotating the top ring disposed at its center on a top surface thereof. A top portion of the rotary to-ring shaft 5 is inserted into a turn arm 6 for the top ring, disposed so as to be drivable and rotatable by a drive unit disposed within the turn arm 6 that in turn is turned by a rotary turn-arm shaft 7. More specifically, the top ring 4 is configured so as to be movable between the delivery tool 138 (138*a* and 138*b*)(FIG. 13) and the polishing table 2 (2*a* or 2*b*), respectively. A polishing fluid supply tube 50 for feeding a polishing fluid (slurry) is also disposed at the top portion of the polishing table 2.

Figure 3:
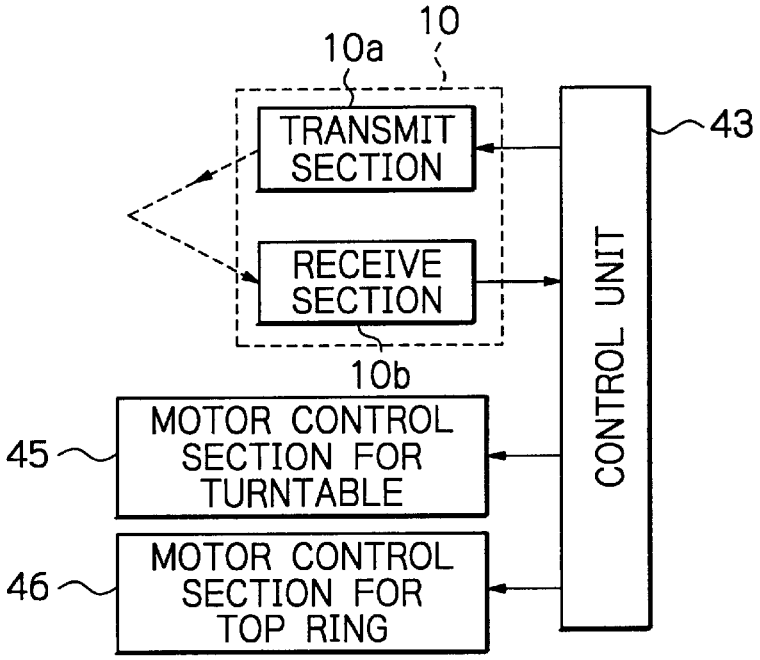
FIG. 3 is a schematic control block diagram for controlling a polishing process by using a supersonic sensor.

In the embodiment of the present invention, a supersonic sensor (a failure detection sensor) 10 is disposed in the vicinity of an outer side of the top ring 4 as shown in FIG. 2. The supersonic sensor 10 is mounted on a sidewall of the turn arm 6 through an arm 51. As shown in FIG. 3, the supersonic sensor 10 is composed of a supersonic wave transmit section 10*a* and a supersonic wave receive section 10*b* disposed therein. The supersonic sensor 10 can compute a distance between the sensor and the surface of a semiconductor wafer by detecting the time required for a supersonic wave emitted from the supersonic wave transmit section 10*a* and reflected from the surface of the wafer to reach the supersonic wave receive section 10*b*.

Now the control of the supersonic sensor 10 will be described with reference to FIG. 3 showing a control block diagram for controlling the polishing apparatus by the supersonic sensor 10. As shown in FIG. 3, signals outputted from the supersonic sensor 10 (composed of the supersonic wave transmit section 10*a* and the supersonic wave receive section 10*b*) are inputted to a control unit 43 and outputted therefrom to a first motor control section 45 for controlling a motor for driving the turntable and to a second motor control section 46 for controlling a motor for driving the top ring. In response to the signals from the control unit 43, the first motor control section 45 controls the rotation of the polishing table 2 and the second motor control section 46 controls the rotation of the top ring 4.

Figure 4:
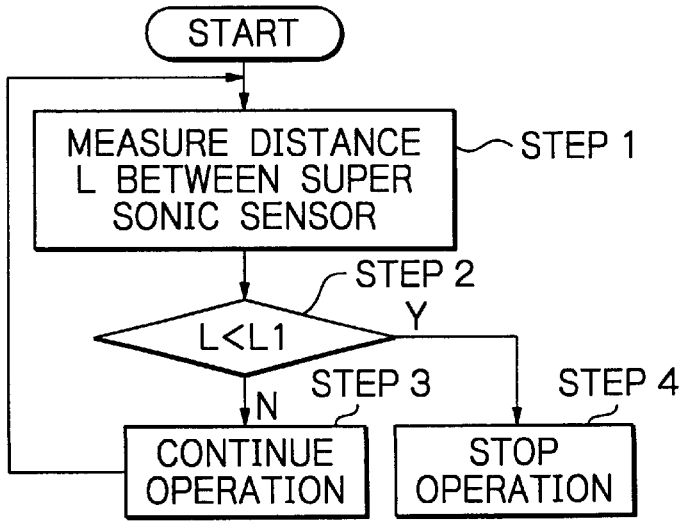
FIG. 4 is a schematic flow diagram showing an example of a method of detecting a failure, while polishing a semiconductor wafer, with the supersonic sensor.

FIG. 4 is a flowchart showing an example of a procedure for detection of a failure upon polishing a semiconductor wafer W by means of the supersonic sensor 10 during a polishing process. A semiconductor wafer W held on the bottom face of the top ring 4 is subjected to polishing by moving a surface of the wafer W in contact with the polishing surface of the polishing tool 1 by rotating the top ring 4 relatively to the polishing table 2. During the polishing of the wafer W, a distance L between the supersonic sensor 10 and a polishing surface (a fluid surface of a polishing fluid) of the polishing tool 1, or an upper surface of the wafer W, or an upper surface of a piece of a broken wafer W on the polishing tool 1, is measured at a predetermined sampling cycle (100 msec for example) (step 1).

More specifically, a time T (a time required for a supersonic pulse, transmitted from the supersonic sensor to the polishing surface of the polishing tool 1, to return to the sensor after reflection from the polishing surface thereof) is measured and the distance L is computed by the control unit 43 on the basis of the following equations:

$$L=V\times T\div 2$$

$$V=f\times\lambda$$

where: V=speed of sound within a supersonic wave propagating medium (air in this embodiment);

f=frequency of a piezoelectric transducer of the supersonic wave transmit section 10*a*; and λ=wavelength of the supersonic wave transmitted.

It is noted herein that FIG. 1 illustrates the transmitting and reflecting waves each having incident and outgoing angles, respectively, for brevity of illustration, although the waves enter and reflect at substantially right angles in an actual situation.

Now, a description will be given regarding an example of the computation of the distance L between the supersonic sensor 10 and the polishing surface of the polishing tool 1 under the conditions wherein a plate thickness of the semiconductor wafer W is 1 mm and the wavelength λ of the supersonic wave to be transmitted is 0.1 mm. The above equations give the frequency f of the piezoelectric transducer of the supersonic wave transmit section 10*a* as f=340 (m/s)/0.1 (mm)=3.40 (MHz). Therefore, the piezoelectric transducer composed of a piezoelectric element or the like, having this frequency f as a natural frequency can be used as a source for transmitting supersonic waves. In this case, when the time T is set to T=0.59 msec, the distance L is measured as L=10 cm from the above equations.

Then, the control unit 43 compares the measured distance L with a threshold value Ll pre-stored in the control unit 43. If the result of the comparison gives L≥L1, this result is determined as normal (step 2) and the polishing operation is continued (step 3). On the other hand, if the result of comparison gives L<L1, it is then determined that the distance between the supersonic sensor 10 and the polishing substrate located thereunder becomes shorter than normal and that foreign material is present between the supersonic sensor 10 and the top surface of the polishing tool 1; that is, for example, either the semiconductor wafer W has jumped from the top ring 4 or a piece of the semiconductor wafer has broken off. In the event of this, it is determined that there is a failure during polishing (step 2), and so the driving of the turntable 2 and the top ring 4 is suspended (step 4).

It is to be noted herein that the threshold value Ll is set as a value computed by statistically processing values obtained by measuring the distance between the sensor and the polishing surface of the polishing tool 1 several times while the semiconductor wafer W is polished under actual polishing conditions, and while the wafer W is held normally with the top ring 4.

At step 4, the driving of the turntable 2 and the top ring 4 is suspended by sending regenerative braking command signals from the control unit 43 to the first motor control section 45 for controlling the rotation of the motor for driving the turntable, and to the second motor control section 46 for controlling the rotation of the motor for driving the top ring, and suspending the driving of the motors by regenerative braking in response to the regenerative braking command signals. In this embodiment, an example is described wherein the drive motors are braked to suspend the driving of the turntable 2 and the top ring 4 by regenerative braking. It is to be noted herein, however, that in place of or in addition to the above embodiment, a so-called mechanical brake may also be used which may be configured, for instance, such that a brake drum is disposed on a rotary section of the turntable 2 and the turntable 2 is braked by pressing a brake shoe against the brake drum. Moreover, the driving of the top ring 4 may be suspended simply by turning power off because the inertia force of the top ring 4 is small.

SECOND EMBODIMENT

Detection of a failure by a supersonic sensor

Figure 5:
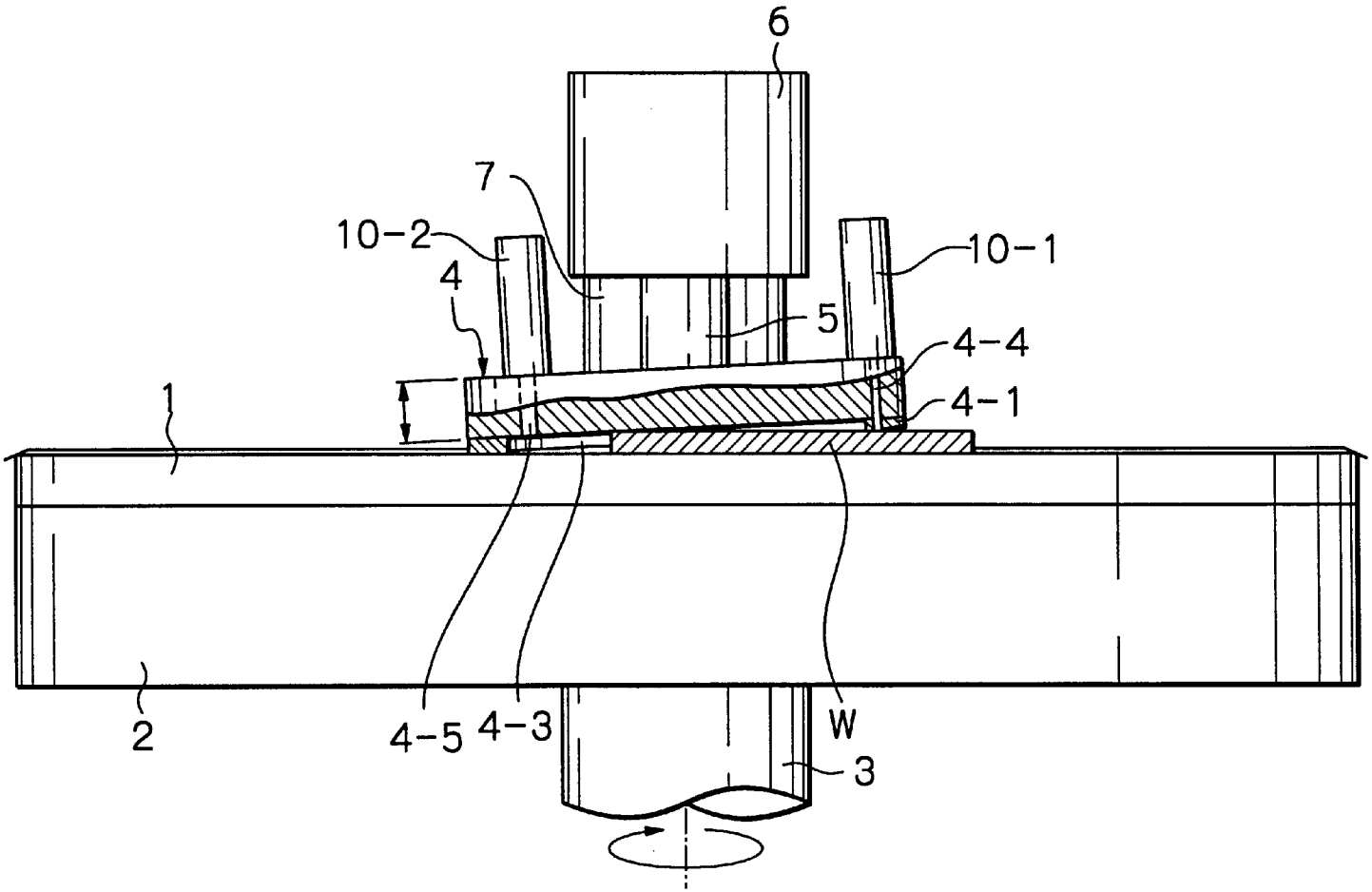
FIG. 5 is a schematic front view showing an essential portion of a polishing table and a top ring for use in a second embodiment of the present invention.

The second embodiment of the polishing apparatus according to the present invention will be described with to FIG. 5 showing the essential portion of the table (turntable) 2 and the top ring 4. In FIG. 5, the parts and elements identical or similar to the parts and elements of the polishing apparatus according to the first embodiment of the present invention are provided with the identical reference numerals and symbols, and a description of the same parts and elements will be omitted from the following explanation.

In the second embodiment of the polishing apparatus, two supersonic sensors (failure detection sensors) 10-1 and 10-2 are mounted on the top surface of the top ring 4. The supersonic sensor 10-1 is disposed on top of a guide ring 4-1 holding an outer periphery of a semiconductor wafer W, and the supersonic sensor 10-2 is disposed at a position inside of the guide ring 4-1. Passages 4-4 and 4-5 extending vertically through the entire thickness of the top ring 4 from the respective supersonic sensors 10-1 and 10-2 are formed at the respective positions at which the supersonic sensors 10-1 and 10-2 are disposed.

Each of the supersonic sensors 10-1 and 10-2 emits supersonic waves through the respective passages 4-4 and 4-5 toward an object and receives the supersonic waves reflected from the object and returned therefrom, in order to measure an intensity of reflection (a sound pressure). A failure while polishing the semiconductor wafer W can be detected on the basis of a variation in the intensity of reflection. Further, in this embodiment, it can be noted that the supersonic frequency of the supersonic waves oscillated by the supersonic sensors 10-1 and 10-2 is set so as to become the frequency corresponding to the resonance frequency of the semiconductor wafer W itself.

Figure 6:
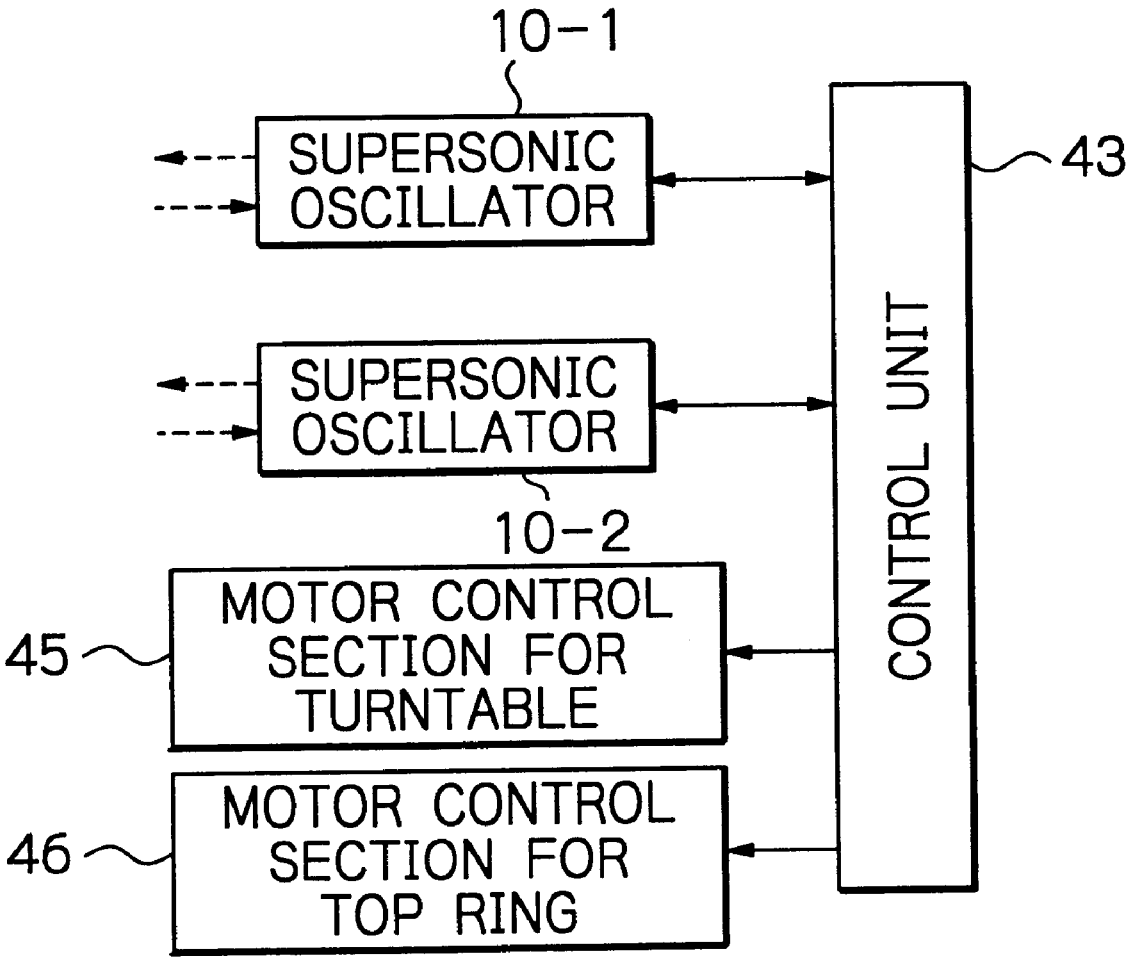
FIG. 6 is a schematic control block diagram for controlling a polishing process by using supersonic sensors.

FIG. 6 is a control block diagram for controlling the polishing apparatus by means of the supersonic sensors 10-1 and 10-2. As shown in FIG. 6, the signals detected by the supersonic sensors 10-1 and 10-2 are entered into control unit 43, and the control unit 43 outputs signals to a first motor control section 45 for controlling a motor for driving the turntable and to a second motor control section 46 for controlling a motor for driving the top ring.

In this embodiment having the configuration as described above, a failure while polishing the semiconductor wafer W may be detected during the following procedures.

First, rotating the top ring 4 and the turntable 2, supporting the polishing surface of the polishing tool 1, polishes a surface of a semiconductor wafer W held on a bottom face of the top ring 4. During this polishing process, the supersonic sensors 10-1 and 10-2 emit supersonic waves continually onto the polishing surface of the polishing tool 1 and a surface of the semiconductor wafer W, and the supersonic waves reflected from the wafer W are received by respective supersonic wave receive sections of the supersonic sensors 10-1 and 10-2. Upon receiving the reflected waves, sound pressure levels Z1 and Z2 are measured, respectively, from sound pressure p. The relationship of the sound pressure level Z (dB) with the sound pressure p ($\mu$Pa) can be indicated by the following equation:

$$Z=10log_{10}(p/20)$$

At this time, the semiconductor wafer W is caused to vibrate by resonance with the supersonic waves transmitted by the supersonic sensor 10-2, so that the sound pressure level Z2 measured by the supersonic sensor 10-2 is lowered. On the other hand, the supersonic waves transmitted by the supersonic sensor 10-1 onto the polishing tool 1 are reflected by the polishing surface thereof so that no resonance is caused and a predetermined sound pressure level Z1 is to be measured.

If the semiconductor wafer W jumps or deviates from the predetermined position of the top ring 4 as shown in FIG. 5, the supersonic waves transmitted from the supersonic sensor 10-2 are reflected by the surface of the polishing tool 1 so that no resonance is caused with the semiconductor wafer W and the sound pressure level Z2 becomes larger. On the other hand, the supersonic waves transmitted from the supersonic sensor 10-1 are reflected by the semiconductor wafer W moving underneath the sensor so that the sound pressure level Z1 is lowered by resonance with the semiconductor wafer W. Further, for instance, in the event where the semiconductor wafer W is broken in the top ring 4, the resonance frequency of the broken wafer is changed so that the sound pressure level Z2 to be measured by the supersonic sensor 10-2 becomes larger.

Then, as shown in FIG. 6, the control unit 43 determines a change of the sound pressure level as an occurrence of a failure while polishing the semiconductor wafer W if at least either one of the sound pressure levels Z1 and Z2 is changed from respective threshold values Z01 and Z02. At this time, controlling the first motor control section 45 and the second motor control section 46 suspends the driving of the turntable 2 and the top ring 4 in substantially the same manner as in the first embodiment.

The threshold values Z01 and Z02 are determined in advance by measuring the sound pressure levels Z1 and Z2 several times while polishing is effected under actual conditions in a state in which the semiconductor wafer W is normally held by the top ring 4, and then by statistically processing the measured sound pressure levels.

When the supersonic sensors 10-1 and 10-2 are disposed above the top ring 4 in the manner as described in this embodiment, a failure during polishing can be detected prior to the wafer W jumping from the top ring 4. Consequently, this embodiment enables detection of a failure during polishing faster than the detection process as in the first embodiment where a jump of the semiconductor wafer W is detected after it has already occurred.

VARIANT OF SECOND EMBODIMENT

Detection of a failure by a supersonic sensor

In the second embodiment of the present invention, the supersonic frequency of the supersonic waves oscillated by the supersonic sensors 10-1 and 10-2 is set as the frequency corresponding to the resonance frequency of the semiconductor wafer W itself. In a variant of the second embodiment; however, this supersonic frequency is set as a frequency other than one corresponding to the resonance frequency. In this case, a failure while polishing the semiconductor wafer W can be detected on the basis of a variation in the intensity of reflection (sound pressure level) measured simply from an object without using damping of the intensity of the reflected waves by the resonance of the semiconductor wafer W.

More specifically, each of the supersonic sensors 10-1 and 10-2 transmits supersonic waves to an object and receives the waves reflected from the object through the passages 4-4 and 4-5, respectively, so that an intensity of reflection (sound pressure levels Z1 and Z2) of the supersonic waves is measured. If it is found that the sound pressure level Z1 (Z2) does not satisfy the relationship as indicated by Zsl<Z1 Zhl (Zs2<Z2<Zh2), then the control unit 43 determines that there has been a failure while polishing the semiconductor wafer W. The driving of the turntable 2 and the top ring 4 is then suspended in substantially the same manner as in each of the previous embodiments.

In these procedures a width of the threshold values is set to be Zsl and Zs2 for the lower sound pressure levels, and Zhl and Zh2 for the higher sound pressure levels, by measuring the sound pressure levels Zl and Z2 several times, respectively, while polishing is effected under actual polishing conditions in a state where the semiconductor wafer W is held normally by the top ring 4.

VARIANTS OF FIRST AND SECOND EMBODIMENTS

Detection of a failure by a radiation temperature sensor

In the first and second embodiments, the supersonic sensors 10, 10-1 and 10-2 are used. In the respective variant embodiments, radiation temperature sensors are used in place of the supersonic sensors 10, 10-1 and 10-2, respectively, at the positions at which the supersonic sensors 10, 10-1 and 10-2 are disposed in the first and second embodiments.

In these variants of the first and second embodiments, the temperature of an object (on the surface of the semiconductor wafer W or the polishing tool 1) is continually measured by the radiation temperature sensors. By continually measuring the temperature of the object, the control unit 43 can detect a failure while polishing the object, including a breakage or jump from a predetermined position, as the measured temperature exceeds a predetermined threshold value (temperature) at which such a polishing failure is caused to occur. Once such a failure is detected, the driving of the turntable 2 and the top ring 4 is suspended in substantially the same manner as in each of the previous embodiments.

THIRD EMBODIMENT

Figure 7:
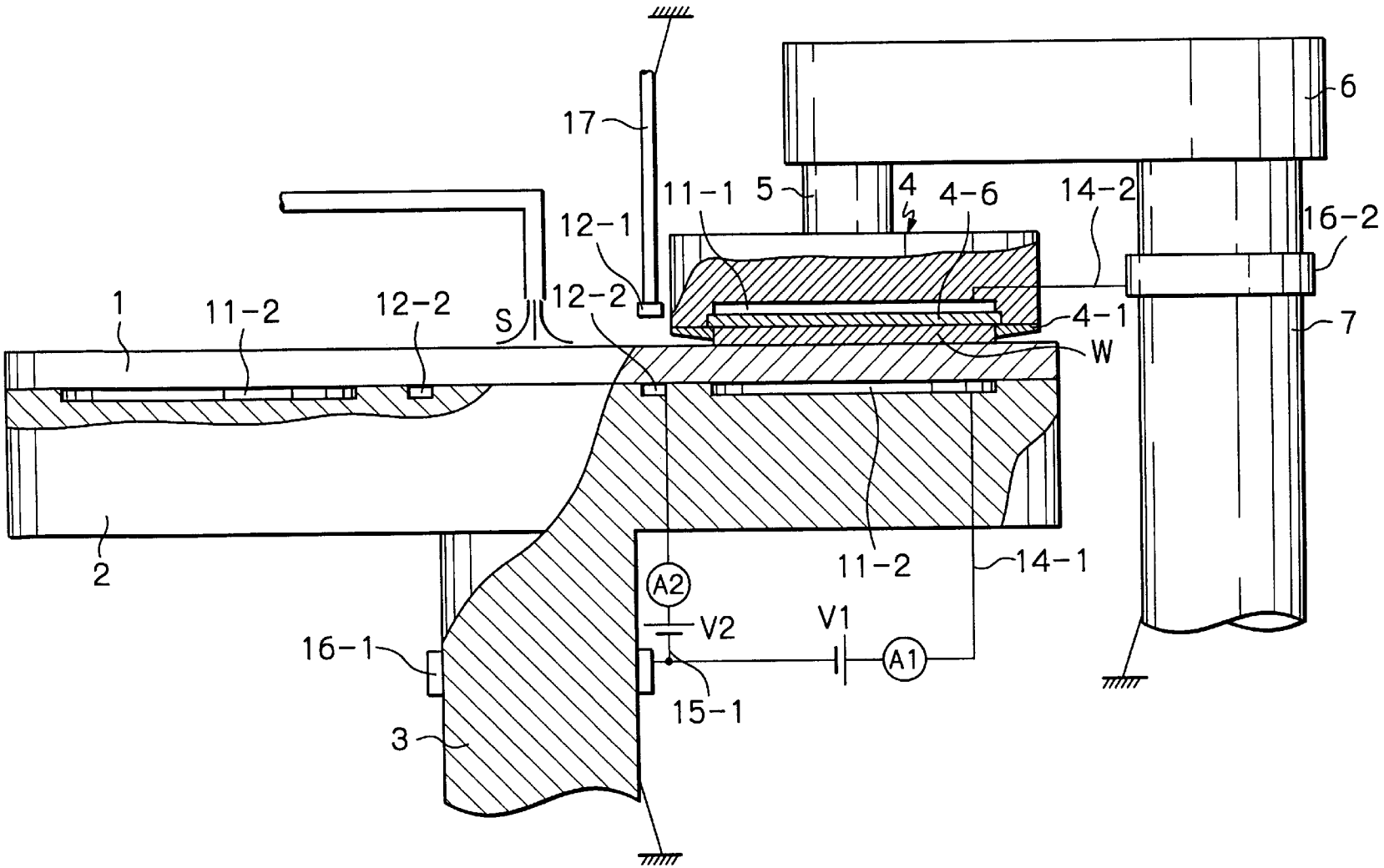
FIG. 7 is a schematic front view showing an essential portion of a polishing table and a top ring for use in a third embodiment of the present invention.

Detection of failure based on a variation in electrostatic capacity of a condenser FIG. 7 shows the essential portion of a polishing table (turntable) 2 and a top ring 4 according to a third embodiment of the present invention. In FIG. 7, the parts and elements identical and similar to those of the first embodiment are provided with the same reference numerals and symbols as those of the first embodiment, and a description of those parts and elements will be omitted in the following specification for brevity of explanation.

In this embodiment, a circular negative-electrode plate 11-1 having substantially the same diameter as a semiconductor wafer W is mounted on a bottom face of the top ring 4 through a backing member 4-6. A circular negative-electrode plate 12-1 is mounted on an end of a conductive support bar 17 at a position close to an outer periphery of the top ring 4. On the other hand, a ring-shaped positive-electrode plate 11-2 is embedded in the turntable 2 at a position opposite the circular negative-electrode plate 11-1. Likewise, a ring-shaped positive-electrode plate 12-2 is embedded in the turntable 2 at a position opposite the circular negative electrode plate 12-1. In other words, the ring-shaped positive-electrode plates 11-2 and 12-2 as well as the circular negative-electrode plates 11-1 and 12-1 constitute condensers such that the ring-shaped positive-electrode plates 11-2 and 12-2 are located in parallel to the circular negative-electrode plates 11-2 and 12-1, respectively, in whichever direction the turntable 2 is rotated. The circular negative-electrode plate 12-1 is disposed above polishing tool 1 at a predetermined distance so as to allow the semiconductor wafer W which has jumped from the top ring 4 to pass through a clearance between the circular negative electrode plate 12-1 and the ring-shaped positive-electrode plate 12-2.

Each of the circular negative-electrode plates 11-1 and 11-2 is grounded, and voltage sources V1 and V2 are connected to the ring-shaped positive-electrode plates 11-2 and 12-2, respectively, so as to apply a predetermined constant voltage to each condenser. Further, ammeters A1 and A2 are connected to the respective ring-shaped positive-electrode plates 11-2 and 12-2. In FIG. 7, reference numerals 16-1 and 16-2 each denote a slip ring.

In this embodiment, the semiconductor wafer W is held by the top ring 4 and polished in substantially the same manner as in the first embodiment. On the other hand, the condenser has an electrical amount $Q=C\times V$ (in which Q is an electrical amount accumulated between condenser electrode plates; C is an electrostatic capacity; and V is a voltage differential between electrode plates). When the voltage differential V is set to be constant, the differentiation of the electrical amount with time t gives $dQ/dt=|=dC/dt\times V$ (in which 1 is an electric current). Therefore, the electric current flows as the electrostatic capacity C varies.

During the polishing of the semiconductor wafer W, the current value of each condenser is continually measured by the respective ammeters A1 and A2. The output of the current values measured by the ammeters A1 and A2 is sent to a control unit (not shown) through a rotary joint (not shown).

As each of the condenser capacities does not vary during a normal polishing process, no current is applied to the ammeters A1 and A2.

On the other hand; however, in the event where a semiconductor wafer W breaks or jumps outside the top ring, the electrostatic capacity of the condenser composed of the circular negative-electrode plate 11-1 and the ring-shaped positive-electrode plate 11-2 changes. Further, the electrostatic capacity of the condenser composed of the circular negative-electrode plate 12-1 and the ring-shaped positive-electrode plate 12-2 changes in the event that the semiconductor wafer W, having jumped from the top ring, passes through the condenser.

Therefore, it is determined in this embodiment that a failure during polishing occurs in the event where either of the current values measured by the ammeters A1 and A2 exceeds a predetermined threshold value as a result of comparison. The threshold value is previously obtained by subjecting the current values to simulation several times, which cause a failure during polishing, for instance, due to breakage or a jump of the polishing substrate W. Alternatively, it is likewise determined as an occurrence of a failure during polishing of the semiconductor wafer W in the event where either one of waveform patterns of a periodical variation of each value measured by the respective ammeters A1 and A2 in a predetermined sampling time agrees with a preset waveform pattern of a periodical variation of the current value at which a failure is caused to occur, for instance, due to breakage or jump of the semiconductor wafer W from the top ring. The waveform pattern to be present may be obtained by subjecting a waveform pattern indicative of a periodical variation in the current values to several simulations, at which such a polishing failure is caused to occur. As it is determined that polishing failure has occurred, the driving of the turntable 2 and the top ring 4 is suspended in substantially the same manner as in the above first embodiment.

In this embodiment, the condenser is disposed inside and outside the top ring 4 such that a failure during the polishing of the semiconductor wafer W is detected. Alternatively, the condenser may be disposed at one location, or a plurality of electrode plates on the side of the top ring may be disposed for the ring-shaped electrode plate on the side of the turntable. The polarity of each of the negative-electrode plates 11-1 and 12-1 and each of the positive-electrode plates 11-2 and 12-2 may be reversed.

The condenser (in this embodiment, composed of the circular negative-electrode plate 12-1 and the ring-shaped positive-electrode plate 12-2) to be disposed outside the top ring 4 may be disposed at the predetermined position by determining in advance the position at which a semiconductor wafer W is most likely to jump or deviate from the top ring by means of simulation.

With the configuration as described above, a failure during polishing can be detected prior to the semiconductor wafer W jumping outside the top ring 4 by locating the condenser inside the top ring 4 as in this embodiment. This system has an advantage in that a polishing failure can be detected faster than in the process of detecting the semiconductor wafer W after the wafer W has jumped outside the top ring 4 as in the first embodiment.

FOURTH EMBODIMENT

Detection of a failure based on a variation in current values

Figure 8A:
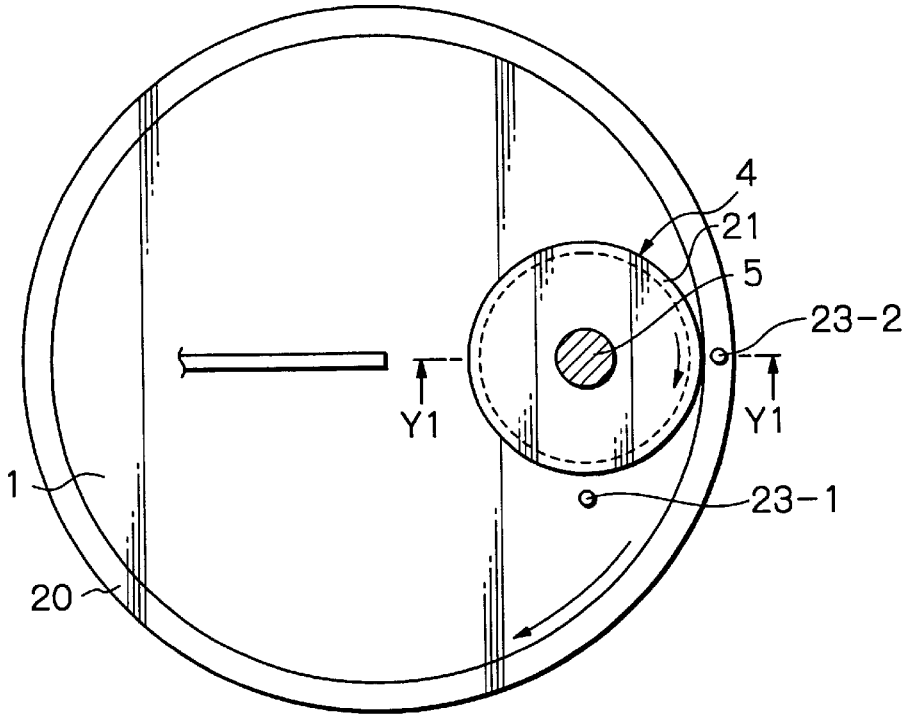
FIGS. 8(*a*) and 8(*b*) are views showing essential portions of a polishing table and a top ring for use in a fourth embodiment of the present invention, in which FIG. 8(*a*) is a schematic plan view showing the essential portions thereof, and FIG. 8(*b*) is a schematic front view showing the essential portions thereof.
Figure 8B:
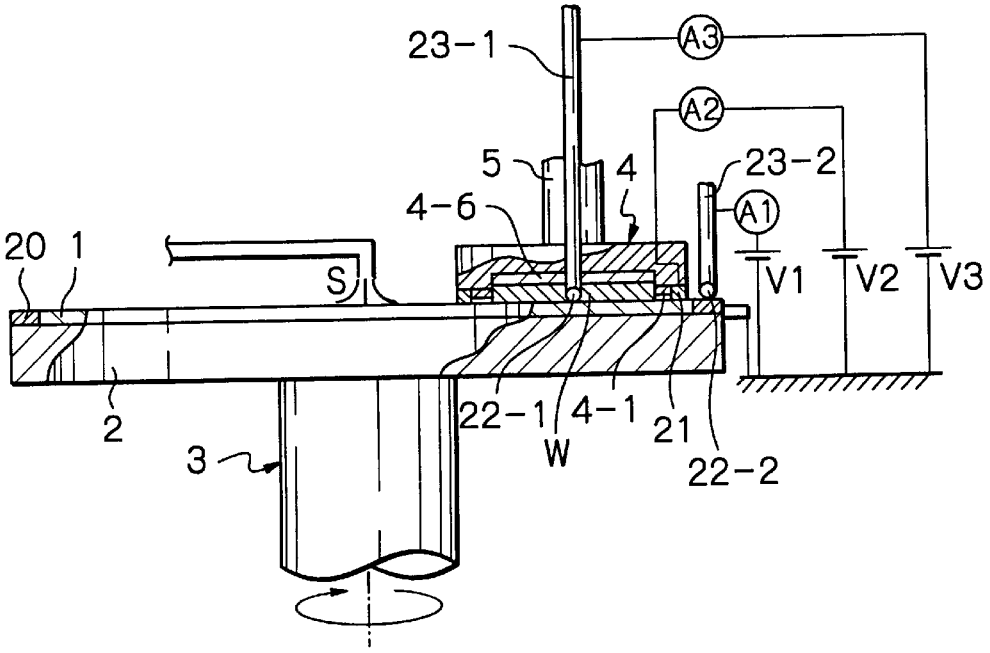

FIGS. 8(*a*) and 8(*b*) depict portions of a polishing table (turntable) 2 and a top ring 4 according to a fourth embodiment of the present invention, in which FIG. 8(*a*) is a schematic plan view of the essential portion thereof and FIG. 8(*b*) is a schematic front view of the essential portion thereof. In this embodiment, the same or similar parts and elements are provided with the same reference numerals and symbols as those of the first embodiment, and a description of those parts and elements will be omitted from the following for brevity of explanation.

IN this embodiment, a ring-shaped contact member 21 is disposed at an outer periphery of the guide ring 4-1 on a bottom face of the top ring 4 so as to be in abutment with the surface of the polishing tool 1. On the other hand, a ring-shaped conductive member 20 is disposed at an outer periphery of the polishing tool 1, and a conductive contact member 22-2 supported by a conductive member 23-2 is located in abutment with the surface of the ring-shaped conductive member 20. Further, a conductive contact member 22-1 supported by a conductive member 23-1 is located in abutment with a surface of the polishing tool 1 outside the top ring 4. The conductive member 23-1 is located at a position at which a semiconductor wafer W jumps, i.e., the position for the turntable 2 which is downstream of the top ring 4.

The ring-shaped conductive member 20 is-grounded, and voltages V1, V2 and V3 are applied to the conductive contact member 22-2, the ring-shaped contact member 21 and the conductive contact member 22-1, respectively. Further, ammeters A1, A2 and A2 are connected to the conductive contact member 22-2, the ring-shaped contact member 21 and the conductive contact member 22-1, respectively.

During a polishing process of the semiconductor wafer W, the polishing tool 1 is electrically connected to the ring-shaped contact member 21 and to the conductive contact member 22-1, and the ring-shaped conductive member 20 is electrically connected to the conductive contact member 22-2. The current values for the connections are continually measured by the ammeters A1, A2 and A3, respectively. As acidic or alkaline slurry is supplied to the polishing tool 1, the electrical connections of each of the contact members with the polishing tool 1 can be performed through the slurry supplied thereto and the ring-shaped conductive member 20, because the polishing tool 1 composed of a polishing member including an abrasive cloth or rubstone is generally high in insulation. The polishing tool 1 may be of a material containing a conductive material. The polishing tool 1 may be completely substituted for the ring-shaped conductive member 20.

If a polishing failure occurs in the event, for instance, where a semiconductor wafer W jumps outside the top ring 4 or breaks, the current values measured by the ammeters A1, A2 and A3 change because the electric connections change due to the semiconductor wafer W having high electrical resistance crossing each of the contact members 21, 22-1 and 22-2 as well as the polishing tool 1.

Therefore, it is determined by a control unit (not shown) that a failure while polishing the semiconductor wafer W occurs, for instance, due to the jumping or breaking of the semiconductor wafer W, in the event where either one of the current values measured by the ammeters A1, A2 and A3 exceeds a predetermined threshold value as a result of comparison. The threshold value is obtained in advance by subjecting the current values to several simulations, at which such a polishing failure is caused to occur. Alternatively, it is determined that such a failure while polishing the semiconductor wafer W occurs in the event that either one of a waveform pattern of a periodical variation of each value measured by the respective ammeters A1, A2 and A3 in a predetermined sampling time agrees with preset waveform patterns W1, W2 and W3, respectively. The waveform patterns W1, W2 and W3 are obtained by subjecting waveform patterns of a periodical variation in the current values to several simulations under conditions that such a polishing failure is caused to occur, for instance, due to jumping or breaking of the semiconductor wafer W. Once it is determined that a polishing failure has occurred, the driving of the turntable 2 and the top ring 4 is suspended in substantially the same manner as in the above first embodiment.

In this embodiment, a polishing failure occurring in the event of the jumping or breaking of the semiconductor wafer W is detected on the basis of a variation in the current values in the vicinity of the guide ring 4-1 and outside the top ring 4. In this embodiment, however, such a failure may be detected by measuring the current value at either location.

FIFTH EMBODIMENT

Figure 9A:
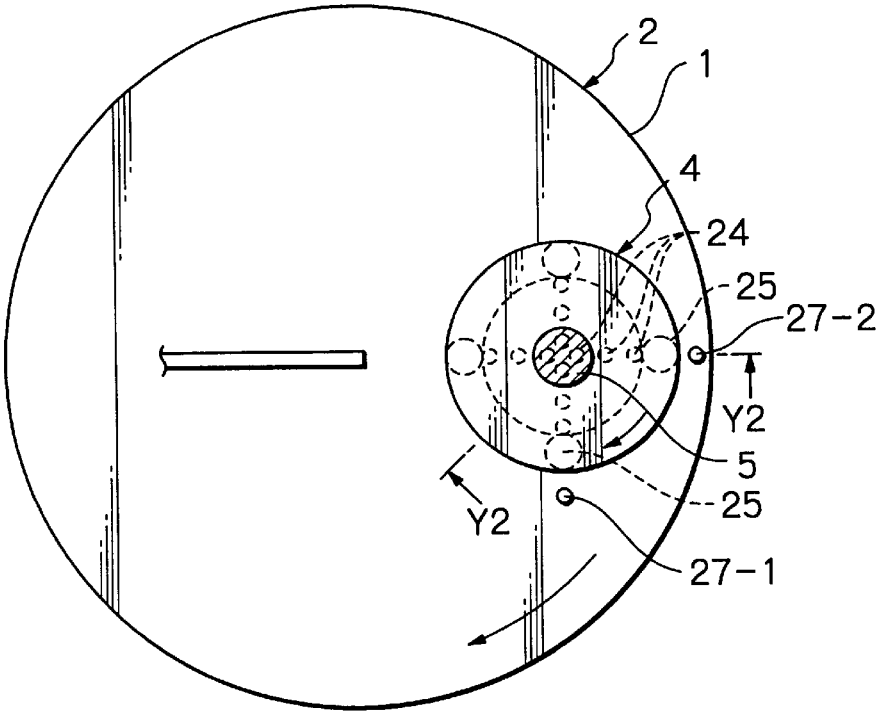
FIGS. 9(*a*) and 9(*b*) are views showing essential portions of a polishing table and a top ring for use in a fifth embodiment of the present invention, in which FIG. 9(*a*) is a schematic plan view showing the essential portions thereof, and FIG. 9(*b*) is schematic front view showing the essential portions thereof.
Figure 9B:
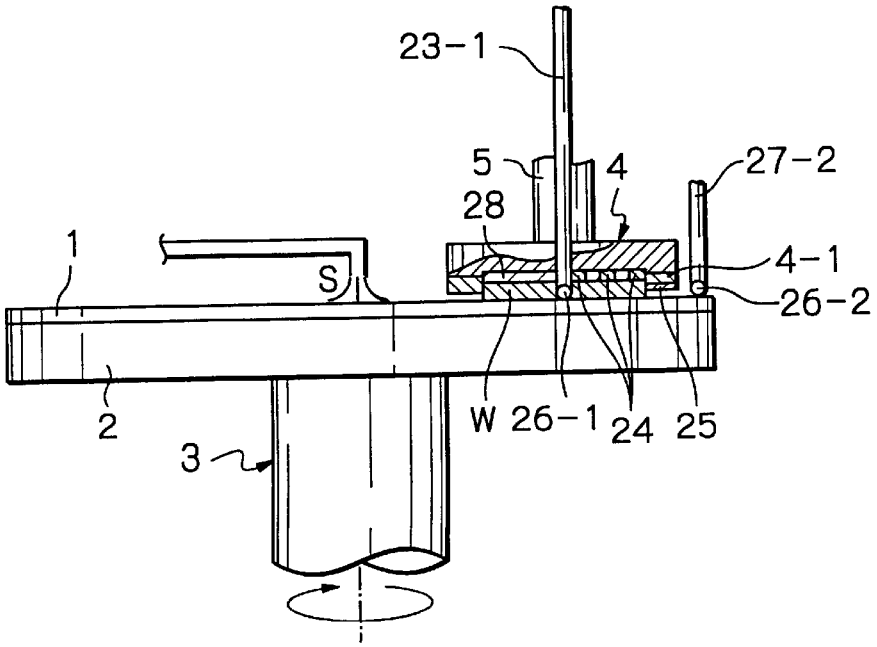

Detection of a failure due to a variation in contact pressure of a piezoelectric element FIGS. 9(*a*) and 9(*b*) illustrate portions of a polishing table (turntable) 2 and a top ring 4 for use in accordance with a fifth embodiment of this invention. FIG. 9(*a*) is a schematic plan view showing the essential portion of the polishing table (turntable) 2 and the top ring 4, and FIG. 9(*b*) is a schematic front view showing the essential portion thereof. The same or similar parts and elements are provided with the same reference numerals and symbols as those of the first embodiment, and a description of those parts and elements will be omitted from the following explanation.

In this embodiment, a spacer 28 is mounted at a bottom surface of the top ring 4 so as to be located inside a guide ring 4-1. The spacer 28 is provided with four groups of bores, each group consisting of three bores arranged in a radial direction, and the four groups are disposed in a circumferentially spaced relationship at an equal interval. A piezoelectric element 24 is disposed in each of the bores. Further, four piezoelectric elements 25 are mounted radially at an equal distance on a bottom surface of a guide ring 4-1 mounted at an outer peripheral portion on the bottom surface of the top ring 4. Moreover, piezoelectric elements 26-1 and 26-2 are disposed on a surface of the polishing tool 1 at predetermined positions outside the top ring 4 and supported by support members 27-1 and 27-2, respectively.

In order to compare current values measured by the piezoelectric elements 24, 25, 26-1 and 26-2 a threshold value of the current values is preset by measuring the current values outputted from each of the piezoelectric elements 24, 25, 26-1 and 26-2 several times and subjecting the measured current values to simulation, at which a polishing failure while polishing a semiconductor wafer W, including a jump or breakage, is caused to occur. Alternatively, each of waveform patterns W1, W2 and W3 of a periodical variation in the current values outputted from the piezoelectric elements 24, 25, 26-1 and 26-2, respectively, are determined by several simulations, at which a failure during polishing is caused to occur, for instance, due to jumping or breaking of the semiconductor wafer W.

During the polishing process of the semiconductor wafer W, the current values of each of the piezoelectric elements 24, 25, 26-1 and 26-2 are continually monitored. In the event, for instance, where the semiconductor wafer W breaks or jumps outside of the top ring 4, the current values outputted from the piezoelectric elements 24, 25, 26-1 and 26-2, vary due to strong abutment of the semiconductor wafer W with each of the piezoelectric elements 24, 25, 26-1 and 26-2, or for other reasons. The measured values are then compared with threshold values by a control unit (not shown), and it is determined as an occurrence of a polishing failure while polishing the semiconductor wafer W in the event that either one of the values measured by the piezoelectric elements 24, 25, 26-1 and 26-2 exceeds a threshold value. Alternatively, it is determined as an occurrence of a polishing failure, such as a jump of breakage of the semiconductor wafer W, when either one of waveform patterns of a periodical variation in the current values measured in a predetermined sampling time agrees with pre-stored waveform pattern W1, W1 or W3. In the event that it is determined that a failure during polishing occurs, the driving of the turntable 2 and the top ring 4 is suspended in substantially the same manner as in the first embodiment.

In this embodiment, a polishing failure caused, for example, by a jumping or breaking of the semiconductor wafer W is detected in a wafer hold section of the top ring 4, under the bottom surface of the guide ring 4-1, and outside the top ring 4. Alternatively, it may be detected at either one or two of the locations as described above.

SIXTH EMBODIMENT

Figure 10:
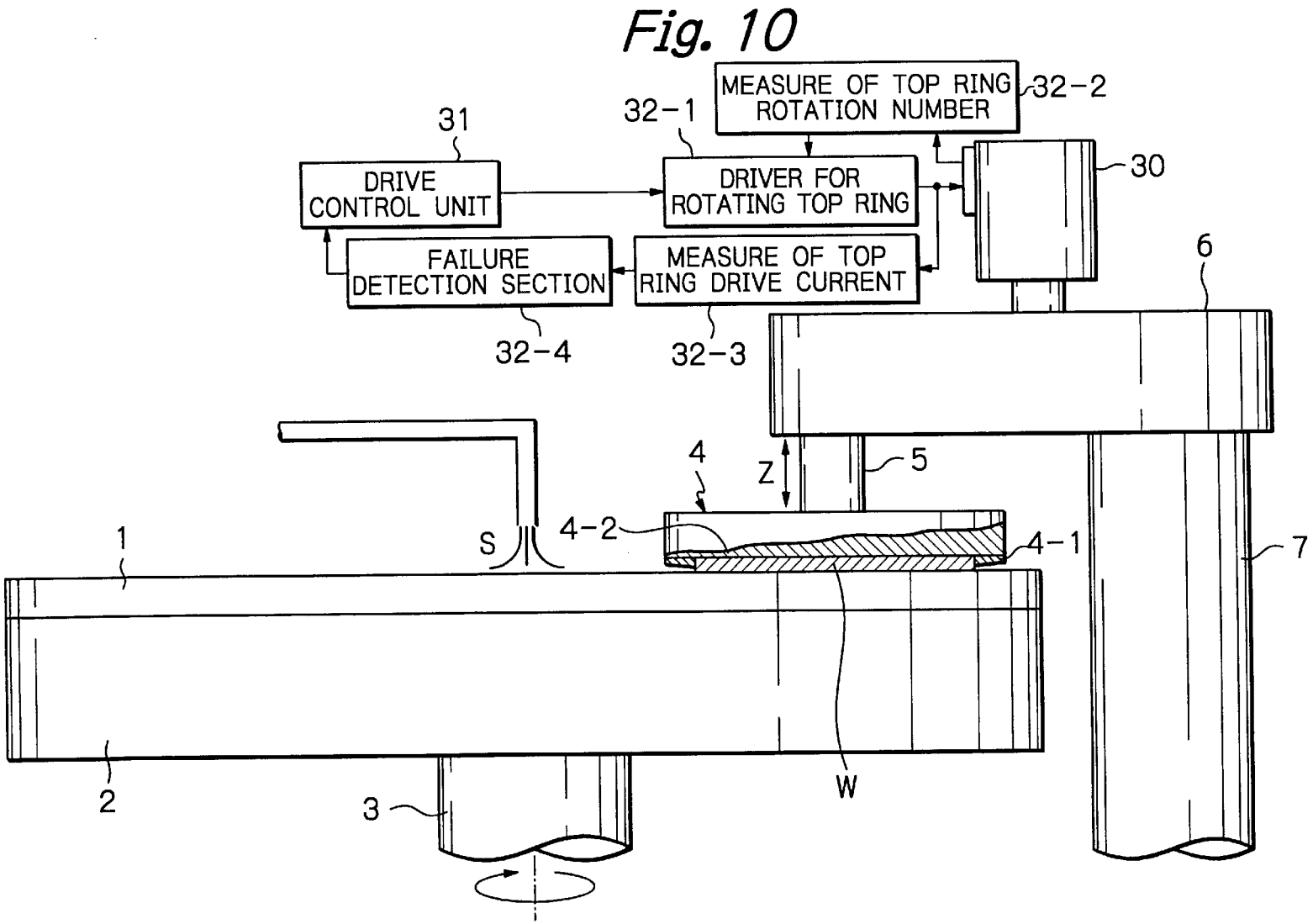
FIG. 10 is a schematic front view showing an essential portion of a polishing table and a top ring for use in a sixth embodiment of the present invention.

Detection of a failure based on a variation in electric current for driving a motor FIG. 10 depicts an example of a polishing apparatus composed of a polishing table (turntable) 2 and a top ring 4 for use in a sixth embodiment. The same or similar parts and elements are provided with the same reference numerals and symbols as those of the first embodiment, and a description of those parts and elements will be omitted from the following explanation.

The polishing apparatus according to this embodiment comprises a polishing tool 1, the turntable 2, the top ring 4, and a rotary arm 6. A semiconductor wafer W held by the top ring 4 is polished by the polishing tool 1 by rotating the turntable 2 at a predetermined number of rotations and lowering or lifting it in the directions as indicated by the arrow Z while pressing the wafer W against the polishing tool 1 at a predetermined pressing pressure with a pressing mechanism (not shown). While the wafer W is pressed against the polishing tool 1, the turntable 2 with the polishing tool 1 mounted thereon is rotated constantly at a predetermined number of rotations. The number of rotations is detected by a measuring device 32-2 for measuring the number of rotations of the top ring 4. A current for rotating the top ring 4 is controlled by a motor driver 32-1 for rotating the top ring 4 so as to drive the top ring 4 at a predetermined number of rotations, and this current is sent to a rotation drive motor 30 for rotating the top ring 4. Then, polishing is carried out by rotating the top ring 4 at a predetermined number of rotations while feeding a polishing material (slurry) S.

As a failure while polishing a semiconductor wafer W occurs, for instance, due to a jump or breakage, resistance to polishing with the polishing tool 1 varies and is proportional to the current value for driving the rotation drive motor 30. Therefore, a failure upon polishing the semiconductor wafer W can be detected by measuring the driving current value. A simulation is carried out several times in the event where a polishing failure occurs, for example, where the semiconductor wafer W jumps or breaks, and a threshold value of a current or a waveform pattern W of a periodical variation in the current value is obtained in advance.

During the polishing process of the semiconductor wafer W, a current for rotating the top ring 4 is continually monitored by a measuring device 32-3 for measuring the current for rotating the top ring. The monitored current value is then compared with the threshold value by means of a failure detection section 32-4 for detecting a jump of the wafer W or other failure thereof. When the monitored current value exceeds the threshold value as a result of comparison, it is then determined that a polishing failure of the semiconductor wafer W, such as jumping or breaking of the wafer W has occurred. Alternatively, it is determined that a polishing failure has occurred when it is found that a waveform pattern of a variation in the current value measured in a predetermined sampling time agrees with the waveform pattern W as described above. In each case, the driving of the turntable 2 and the top ring 4 is suspended in substantially the same manner as in the first embodiment.

In this embodiment, an occurrence of a failure while polishing, including a jumping or breakage of the semiconductor wafer W, may be detected in substantially the same manner as described above by measuring a current for rotating the turntable 2. Alternatively, a change of the current values may be detected by simultaneously measuring the current values of the turntable 2 and the top ring 4. Then, the driving of the turntable 2 and the top ring 4 can be suspended in substantially the same manner as described above.

SEVENTH EMBODIMENT

Detection of a failure by a vibration sensor

Figure 11:
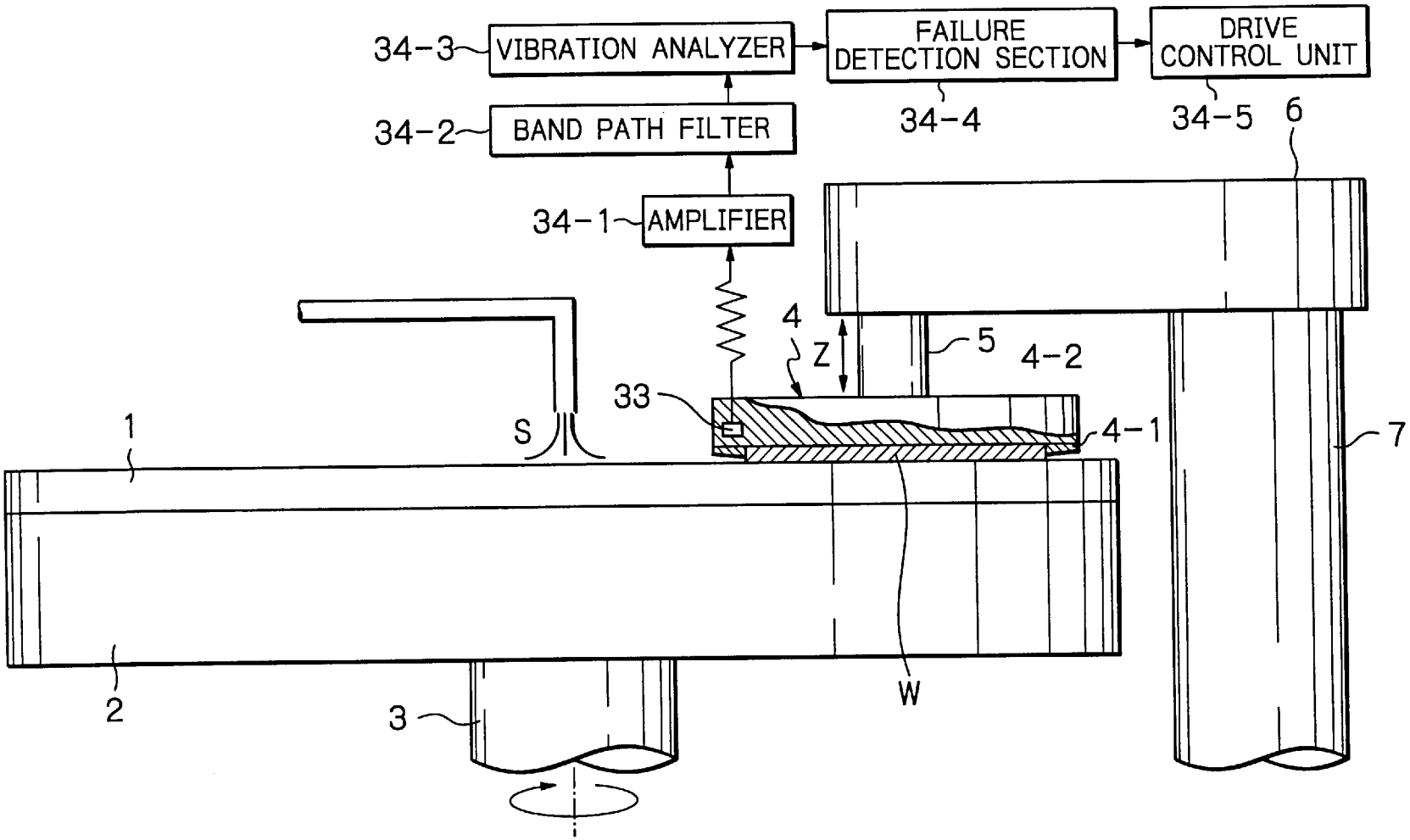
FIG. 11 is a schematic front view showing an essential portion of a polishing table and a top ring for use in a seventh embodiment of the present invention.

FIG. 11 shows the essential portion of a polishing table (turntable) 2 and a top ring 4 for use with a polishing apparatus in this embodiment. The same or similar parts and elements are provided with the same reference numerals and symbols as those of the first embodiment, and a description of those parts and elements will be omitted from the following specification.

For the polishing apparatus in this embodiment, the top ring 4 is provided with a vibration sensor 33, and a polishing failure, such as a jump or other abnormal events of the semiconductor wafer W, is detected on the basis of the signals measured continually with the vibration sensor 33 during a polishing process. The signals indicative of vibration detected by the vibration sensor 33 equipped in the top ring 4 are transmitted to an amplifier 34-1 in a wireless fashion. Further, a band path filter 34-2 is connected to the amplifier 34-1 so as to extract a frequency component required for the detection of the signals indicative of the polishing failure exclusively from the vibration signals amplified by the amplifier 34-1. To the band path filter 34-2 is connected a vibration analyzer 34-3 for analyzing the vibration of the signals outputted from the band path filter 34-2, and the signals analyzed are inputted into a failure detection section 34-4 that detects a failure while polishing the semiconductor wafer W and generates a signal for suspending the polishing process in the event that the polishing failure is detected. The suspension signal generated by the failure detection section 34-4 is then transmitted to a drive control unit 34-5 for controlling a drive of the polishing apparatus.

To compare with the measured vibration value, a threshold value is preset in the failure detector 34-4, and it is determined that a failure while polishing the semiconductor wafer W occurs when the signal analyzed and outputted by the vibration analyzer 34-3 exceeds the threshold value. Once it is determined that the failure during polishing has occurred, the suspension signal is outputted to the drive control unit 34-5 to suspend the driving of the turntable 2 and the top ring 4 in substantially the same manner as in the first embodiment.

In this embodiment, the vibration sensor 33 is used. A distortion sensor or a pressure sensor may be used in place of the vibration sensor. Moreover, a plurality of sensors of an equal type or of a different type may be used, and the sensors may be disposed such that operation of the polishing apparatus is caused to be suspended in the event that either one of the sensors detects a polishing failure.

EIGHTH EMBODIMENT

Detection of a failure by a displacement sensor

Figure 12:
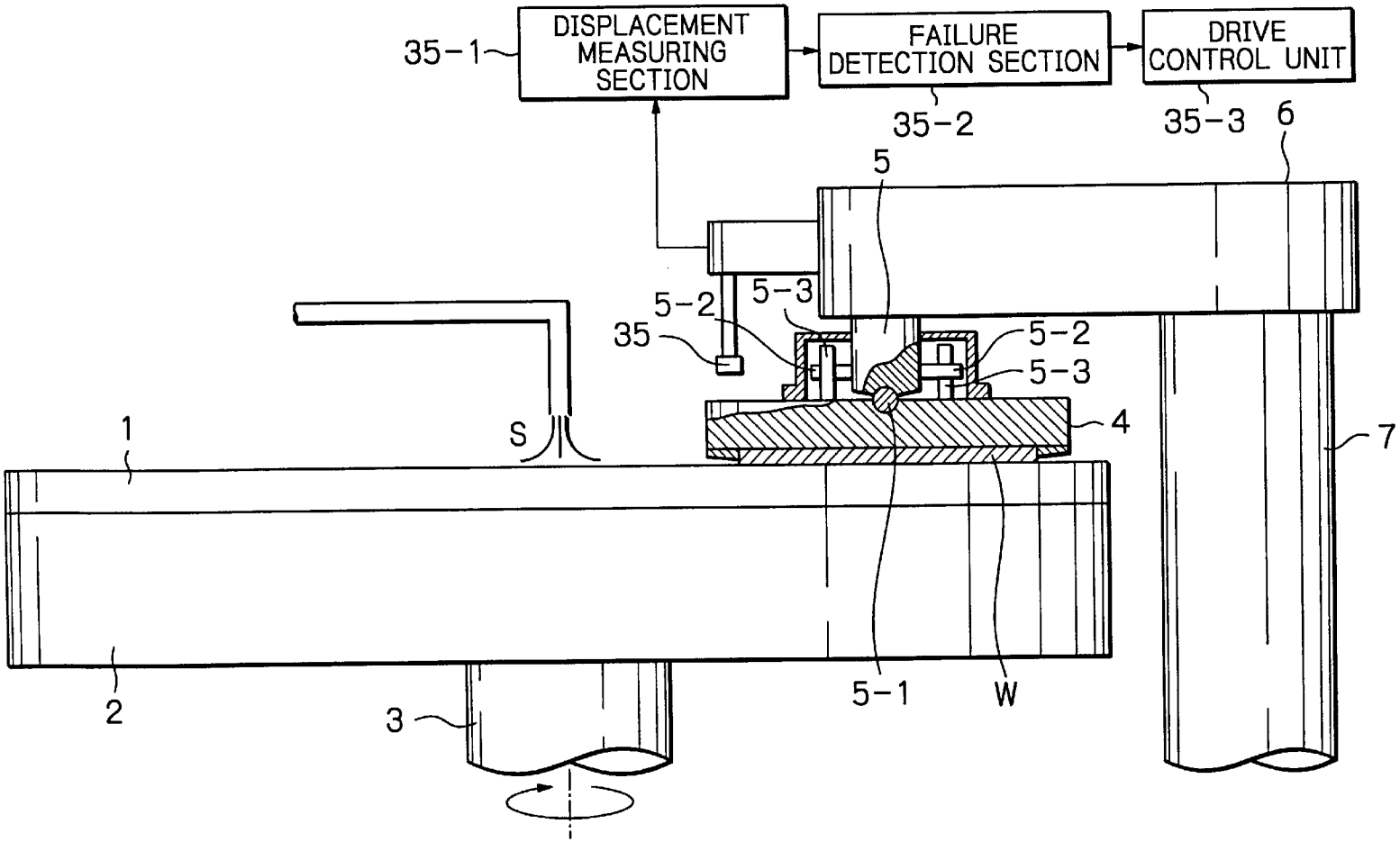
FIG. 12 is a schematic front view showing an essential portion of a polishing table and a top ring for use in an eighth embodiment of the present invention.

FIG. 12 shows a polishing table (turntable) 2 and a top ring 4 for use with a polishing apparatus according to an eighth embodiment of the present invention. The same or similar parts and elements are provided with the same reference numerals and symbols as those of the first embodiment, and a description of those parts and elements will be omitted from the following explanation.

For the polishing apparatus in this embodiment, a displacement sensor 35 of a non-contact type is disposed over the top ring 4 so as to measure a variation in position of a top surface of the top ring 4. The variation in the position of the top surface of the top ring 4 is continually measured by the displacement sensor 35 during a polishing process in order to detect a failure while polishing a semiconductor wafer W. In this embodiment, a displacement sensor of a contact type may also be used in place of the displacement sensor 35.

In this embodiment, a signal outputted from the displacement sensor 35 of the non-contact type is transmitted to a displacement measuring section 35-1 that translates the signal to a displacement amount. The displacement measuring section 35-1 is connected to a failure detection section 35-2 for detecting a polishing failure, including a jump or breakage of the semiconductor wafer W, on the basis of the displacement amount outputted from the displacement measuring section 35-1. Once the polishing failure is detected by the failure detection section 35-2, a suspension signal is transmitted from the failure detection section 35-2 to a drive control unit 35-3 which in turn suspends driving of the polishing apparatus.

For a comparison with the measured displacement value, a threshold value is preset in the failure detection section 35-2, and it is determined that a failure while polishing a semiconductor wafer W occurs, such as a jump or breakage of the wafer W, in the event that the displacement amount outputted from the displacement measuring section 35-1 exceeds the threshold value. Once the polishing failure is detected, a suspension signal is transmitted to the drive control unit 35-3 to suspend operation of the turntable 2 and the top ring 4 in substantially the same manner as described above.

In FIG. 12, reference numeral 5-1 denotes a spherical bearing, and each of reference numerals 5-2 and 5-3 denotes a torque transmission pin.

EFFECTS OF THE INVENTION

The polishing apparatus according to the present invention is provided with a detection system for detecting a failure while polishing a substrate, including a jump or breakage of the substrate, so that a failure while polishing the substrate can be detected accurately during a polishing process. Therefore, once the polishing failure is detected, the operation for polishing the substrate can be immediately suspended to prevent the substrate itself or devices or parts constituting a guide ring, an abrasive cloth, a backing member and a dressing member from being damaged by a jump of the substrate from a top ring.

What is claimed is:

1. A polishing apparatus comprising:

a polishing tool;

a substrate holding member to hold a substrate and press a surface of the substrate against said polishing tool while said polishing tool and said substrate holding member move relative to one another in order to polish the substrate;

a measuring device to measure a drive current of a drive unit while the drive unit drives at least one of said polishing tool and said substrate holding member; and a failure detection unit to detect breakage of the substrate based on (i) comparison of a value of the drive current, during polishing of the substrate, with a threshold value, or (ii) comparison of a waveform pattern of the drive current, during polishing of the substrate, with a predetermined waveform pattern.

2. The polishing apparatus according to claim 1, further comprising a driving suspension device to cease driving of said at least one of said polishing tool and said substrate holding member via the drive unit when said failure detection unit detects breakage of the substrate.

3. The polishing apparatus according to claim 2, wherein said driving suspension device is to cease driving of said polishing tool and said substrate holding member when said failure detection unit detects breakage of the substrate.

4. The polishing apparatus according to claim 1, wherein said failure detection unit is to detect breakage of the substrate based on comparison of a value of the drive current, during polishing of the substrate, with a threshold value.

5. The polishing apparatus according to claim 1, wherein said failure detection unit is to detect breakage of the substrate based on comparison of a waveform pattern of the drive current, during polishing of the substrate, with a predetermined waveform pattern.

6. A polishing apparatus comprising:

a polishing tool;

a substrate holding member to hold a substrate and press a surface of the substrate against said polishing tool while said polishing tool and said substrate holding member move relative to one another in order to polish the substrate;

a measuring device to measure a drive current of a drive unit while the drive unit drives at least one of said polishing tool and said substrate holding member; and a failure detection unit to detect jumping of the substrate from said substrate holding member based on (i) comparison of a value of the drive current, during polishing of the substrate, with a threshold value, or (ii) comparison of a waveform pattern of the drive current, during polishing of the substrate, with a predetermined waveform pattern.

7. The polishing apparatus according to claim 6, further comprising a driving suspension device to cease driving of said at least one of said polishing tool and said substrate holding member via the drive unit when said failure detection unit detects jumping of the substrate from said substrate holding member.

8. The polishing apparatus according to claim 7, wherein said driving suspension device is to cease driving of said polishing tool and said substrate holding member when said failure detection unit detects jumping of the substrate from said substrate holding member.

9. The polishing apparatus according to claim 6, wherein said failure detection unit is to detect jumping of the substrate from said substrate holding member based on comparison of a value of the drive current, during polishing of the substrate, with a threshold value.

10. The polishing apparatus according to claim 6, wherein said failure detection unit is to detect jumping of the substrate from said substrate holding member based on comparison of a waveform pattern of the drive current, during polishing of the substrate, with a predetermined waveform pattern.

11. A polishing apparatus comprising:

a polishing tool;

a substrate holding member to hold a substrate and press a surface of the substrate against said polishing tool while said polishing tool and said substrate holding member move relative to one another in order to polish the substrate;

a measuring device to measure a drive current of a drive unit while the drive unit drives at least one of said polishing tool and said substrate holding member; and a failure detection unit to detect a polishing failure of the substrate based on comparison of a waveform pattern of the drive current, during polishing of the substrate, with a predetermined waveform pattern.

12. The polishing apparatus according to claim 11, further comprising a driving suspension device to cease driving of said polishing tool and said substrate holding member when said failure detection unit detects the polishing failure of the substrate.

* * * * *